US006629418B1

(12) United States Patent
Gao et al.

(10) Patent No.: US 6,629,418 B1
(45) Date of Patent: Oct. 7, 2003

(54) TWO-STAGE INTER-PHASING PULSE TUBE REFRIGERATORS WITH AND WITHOUT SHARED BUFFER VOLUMES

(75) Inventors: Jin Lin Gao, Wescosville, PA (US); Ralph C. Longsworth, Allentown, PA (US)

(73) Assignee: SHI-APD Cryogenics, Inc., Allentown, PA (US)

( * ) Notice: Subject to any disclaimer, the term of this patent is extended or adjusted under 35 U.S.C. 154(b) by 0 days.

(21) Appl. No.: 10/041,700

(22) Filed: Jan. 8, 2002

(51) Int. Cl.[7] ..... F25B 9/00

(52) U.S. Cl. ..... 62/6; 60/520

(58) Field of Search ..... 62/6; 60/520

(56) References Cited

U.S. PATENT DOCUMENTS

| | | | | |
|---|---|---|---|---|
| 5,107,683 | A | | 4/1992 | Chan et al. |
| 5,335,505 | A | | 8/1994 | Ohtani et al. |
| 5,711,156 | A | | 1/1998 | Matsui |
| 5,845,498 | A | | 12/1998 | Matsui et al. |
| 5,927,081 | A | | 7/1999 | Li |
| 5,974,807 | A | | 11/1999 | Gao et al. |
| 6,094,921 | A | * | 8/2000 | Zhu et al. ..... 62/6 |

OTHER PUBLICATIONS

Zhu, S. and Wu, P., "Double inlet pulse tube refrigerators: an important improvement", Cryogenics, vol. 30 (1990), p. 514.

A. Watanabe, G. W. Swift, and J. G. Brisson, Superfluid orifice pulse tube below 1 Kelvin, Advances in Cryogenic Engineering, vol. 41B, pp. 1519–1526 (1996).

J. L. Gao and Y. Matsubara, An inter–phasing pulse tube refrigerator for high refrigeration efficiency, in: "Proceedings of the 16th International Cryogenic Engineering Conference", T. Haruyama, T. Mitsui and K. Yamafriji, ed., Eisevier Science, Oxford (1997), pp. 295–298.

C. K. Chan, and E. Tward, Multistage pulse tube cooler, U.S. patent 5,107,683, Apr. 28, 1992.

C. K. Chan, C.B. Jaco, J. Raab, E. Tward, and M. Waterman, Miniature pulse tube cooler, Proc. 7th Int'l Cryocooler Conf., Air Force Report PL–CP–93–1001 (1993) pp. 113–124.

Y. Matsubara, J.L. Gao, K. Tanida, Y Hiresaki, and M. Kaneko, An experimental and analytical investigation of pulse tube refrigerator, Proc. 7th Int'l Cryocooler Conf., Air Force Report PL–CP–93–1001 (1993) pp. 166–186.

* cited by examiner

*Primary Examiner*—Ronald Capossela
(74) *Attorney, Agent, or Firm*—Katten Muchin Zavis Rosenman

(57) ABSTRACT

Disclosed are two-stage inter-phasing pulse tube refrigerators with and without shared buffer volumes.

11 Claims, 12 Drawing Sheets

TWO-STAGE INTER-PHASING PULSE TUBE REFRIGERATORS WITH AND WITHOUT SHARED BUFFER VOLUMES

BACKGROUND OF THE INVENTION

The pulse tube refrigerator is a cryocooler, similar to Stirling and Gifford-McMahon refrigerators, that derives cooling from the compression and expansion of gas. However, unlike the Stirling and Gifford-McMahon (G-M) systems, in which the gas expansion work is transferred out of the expansion space by a solid expansion piston or displacer, pulse tube refrigerators have no moving parts in their cold end, but rather an oscillating gas column within the pulse tube (called a gas piston) that functions as a compressible displacer. The elimination of moving parts in the cold end of pulse tube refrigerators allows a significant reduction of vibration, as well as greater reliability and lifetime, and is thus potentially very useful in many applications, both military and commercial.

Cryogenic temperatures such as those achievable using two stage pulse tube refrigerators, are highly desirable in such commercial applications as cooling the superconducting magnets used in magnetic resonance imiaging (MRI) systems to 4 K or for cooling cryopumps, which are often used to purge gases from semiconductor fabrication vacuum chambers, to 10 K.

Smaller cryocoolers are desirable in the most common applications to which pulse tube refrigerators lend themselves, such as semiconductor fabrication chambers, where continual efforts are made to reduce component size. Conventional two-stage pulse tube refrigerators, while capable of achieving two-stage refrigeration (e.g. 4 K and 10 K), require a relatively large buffer volume(s) for the two stages and are potentially less compact than Stirling or G-M refrigerators, in which the two stages require no buffer volume. Thus, any size reduction in pulse tube refrigerators is highly desirable, especially in two-stage designs that utilize one or more buffer volumes. What is needed is a way to design a more compact two-stage pulse tube refrigerator.

Conventional cryocoolers, such as Stirling and G-M refrigerators, include a moving displacer, which necessitates the inclusion of elements such as seals in the expansion space; this presents reliability problems and necessitates maintenance of such systems at regular intervals. The typical interval of 12,000 to 15,000 hours between maintenance is not a long time considering that many applications require the cryocoolers to operate indefinitely. It is desirable in such applications to strive for maintenance-free cryocooler designs. What is needed is a way to increase the maintenance interval and the reliability of a cryogenic refrigerator.

The exclusion of moving parts in the cold end of pulse tube refrigerators results in a great reduction in the level of vibration when compared to systems that are cooled by more conventional refrigerators, such as G-M and Stirling systems. The quality and uniformity of the chips produced in semiconductor fabrication vacuum chambers, in which pulse tube refrigerators may be used in cryopumps to "freeze out" or purge gases, may be greatly affected by the vibration of components within the chamber, which is likely to stir up dust and other particulate matter. Likewise, pulse tube refrigerators lend themselves nicely to MRI applications, in which a large superconducting magnet must remain cooled to as low as 4 K. Even the slightest vibration of any metal component in the magnetic field produced by the superconducting magnet results in interference and degrades the quality of the produced image. What is needed is a way to minimize vibration in applications requiring two-stage cryogenic refrigeration.

Conventional pulse tubes with single or double orifice control use large buffer volumes to get good efficiency, or "four valve" control to eliminate or minimize the size of the buffer volume but at the expense of efficiency. What is needed is away to design a compact pulse tube with good efficiency.

Gao et al., U.S. Pat. No. 5,974,807, entitled "Pulse tube refrigerator," describes a pulse tube refrigerator capable of generating cryogenic temperatures of below 10 K that includes first and second refrigeration stages. Each stage includes a pulse tube and an associated regenerator provided at the low temperature side of the pulse tube. A pressure fluctuation generator having a compressor and a first to a fourth valve is provided at the high temperature side of each regenerator. The high temperature sides of each pulse tube are connected by a continuous channel, while the high temperature sides of each pulse tube and the high temperature sides of each regenerator are connected by a by-pass channel. A magnetic material having a rare-earth element and a transition metal is used as a regenerative material for the regenerator.

When pressure fluctuation is generated in each pulse tube at the phase difference angle of 180 degrees, respectively, a working gas is transferred between the high temperature sides of each pulse tube by an active valve, thereby optimizing the phase angle between the pressure fluctuation in each pulse tube and the displacement of the working gas. The flow amount of the operating gas sent to each pulse tube from the regenerator is limited using a fixed orifice in the by-pass channel.

This patent describes active and passive inter-phase control with fixed restrictors for the second orifices. No buffer volume is included. This is possible because there two identical two-stage pulse tubes that are interconnected so the volumes and temperatures match.

Matsui et al., U.S. Pat. No. 5,845,498, entitled "Pulse tube refrigerator," describes a pulse tube refrigerator where the cryostat includes regenerators and pulse tubes. Each regenerator has a cold stage at an upper end thereof. Each pulse tube has a low-temperature end portion at a lower end thereof and a high-temperature end portion thereof, the low-temperature end portion being located lower than the cold stage. The cold stage and the low-temperature end portion are connected to each other through a line whose cubic volume is substantially negligible in comparison with that of the pulse tube. Since the pulse tube has working gas of relatively high density in an upper portion thereof and working gas of relatively low density in a lower portion thereof, there is no convection of working gas induced by the gravity.

This patent exemplifies the problems of applying prior art concepts to creating a configuration that is preferred for cooling cryopumps, namely having the valve mechanism below the cryopump housing. The hot end of a pulse tube has to be above the cold end in order to avoid serious convection losses in the pulse tube. This patent describes several different conventional control mechanisms for single warm regenerator designs (no inter-phase control). FIG. 2 illustrates the problems of having large dead volumes in connect tubes 36, 37, and 38, which are needed to keep the warm end of the pulse tube above the cold end with the valve mechanism below the pulse tube. The conventional construction shown as prior art in FIG. 1 is suitable for cooling a cryopump if there is room for the valve mechanism above the cryopump housing.

Matsui et al., U.S. Pat. No. 5,711,156, entitled "Multistage type pulse tube refrigerator," describes a multistage G-M type pulse tube refrigerator comprising a regenerator-side pressure oscillation generator, first regenerator connected to the regenerator-side pressure oscillation generator, first cold head connected to the low temperature side of the first regenerator, a first pulse tube having one end connected to the first cold head and the other end connected by way of a first flow regulating mechanism to a first pulse tube-side phase shifter, second regenerator having one end connected to the first cold head and the other end connected to the second cold head, a second pulse having one end connected to the second cold head and the other end connected to second pulse tube-side phase shifter by way of second flow regulating mechanism, in which the first pulse tube-side phase shifter and the second pulse tube-side phase shifter are controlled independently of each other. The pulse tube refrigerator operates while setting the phase angle of the pulse tube-side phase shifter to −50 degrees to a −120 degree phase angle relative to the regenerator-side pressure oscillation generator, while setting the phase angle of the second pulse tube-side phase shifter 15 degrees to a −90 degree phase angle.

This patent describes a two-stage pulse tube with a single warm regenerator, (no inter-phase control). It uses the "four valve" method to control the flow of gas to each stage without having any buffer volumes. The valve timing may be different for each stage. This patent shows examples of conventional multi-ported rotary valves, FIGS. 4, 5, and 6.

Ohtani et al., U.S. Pat. No. 5,335,505, entitled "Pulse tube refrigerator," describes a pulse tube refrigerator, comprising a regenerator having an inlet port and an outlet port, a pulse tube having one end portion connected in series to the outlet port of the regenerator, a gas compressor connected to the inlet port of the regenerator, a first valve disposed between the discharge port of the gas compressor and the inlet port of the regenerator, a second valve disposed between the suction port of the gas compressor and the inlet port of the regenerator, a first valve controller for selectively opening/closing alternately the first and second valves to permit a high pressure coolant gas discharged from the discharge port of the gas compressor to be guided into the pulse tube through the regenerator and, then, to permit said coolant gas to be sucked into the gas compressor through the suction port thereof via the reverse passageway so as to generate coldness, a third valve disposed between the other end portion of the pulse tube and the discharge port of the gas compressor, a fourth valve disposed between the other end portion of the pulse tube and the suction port of the gas compressor, and a second valve controller serving to open/close the third and fourth valves in relation to the opening/closing of the first and second valves.

This patent covers the "four valve" control concept, with and without a buffer volume. It describes single warm regenerator designs, (no inter-phase control). Inline designs with the valve mechanism below the pulse tubes and the hot end of the pulse tubes up are shown.

Zhu, S. and Wu, P., "Double inlet pulse tube refrigerators: an important improvement", Cryogenics, vol. 30 (1990), p. 514 describe a second orifice and how it improves the performance of a single stage pulse tube.

A. Watanabe, G. W. Swift, and J. G. Brisson, Superfluid orifice pulse tube below 1 Kelvin, Advances in Cryogenic Engineering, Vol. 41B, pp. 1519–1526 (1996) describe inter-phase control of a very low temperature Stirling cycle cooler that has one passive orifice between two identical pulse tubes.

J. L. Gao and Y. Matsubara, An inter-phasing pulse tube refrigerator for high refrigeration efficiency, in: "Proceedings of the 16th International Cryogenic Engineering Conference", T. Haruyama, T. Mitsui and K. Yamafriji, ed., Eisevier Science, Oxford (1997), pp. 295–298, describe identical dual 1, 2, and 3 stage pulse tubes with single active interconnect valves.

C. K. Chan, and E. Tward, Multistage pulse tube cooler, U.S. Pat. No. 5,107,683, Apr. 28, 1992.

This patent describes a second stage pulse tube that extends from the coldest temperature to ambient temperature with no intermediate regenerator material.

C. K. Chan, C. B. Jaco, J. Raab, E. Tward, and M. Waterman, Miniature pulse tube cooler, Proc.7$^{th}$ Int'l Cryocooler Conf., Air Force Report PL-CP—93-1001 (1993) pp. 113–124, describe a Stirling single stage pulse tube that is inline, so the hot end of the pulse tube is remote from the regenerator inlet. It has double orifice control. Heat from the hot end of the pulse tube and buffer are rejected to the base at the regenerator inlet by conduction through the buffer housing which extends the full length of the pulse tube. The hot end of the pulse tube is not attached to the vacuum housing so the entire pulse tube assembly can be easily removed.

Y. Matsubara, J. L. Gao, K. Tanida, Y. Hiresaki, and M. Kaneko, An experimental and analytical investigation of 4 K pulse tube refrigerator, Proc.7th Int'l Cryocooler Conf., Air Force Report PL-CP—93-1001 (1993) pp. 166–186, describe the "4 valve" control concept and describes why it increases the PV work produced in the cold end of the pulse tube relative to double orifice control.

It is an object of the present invention to provide a more compact two-stage pulse tube refrigerator by minimizing the size of the buffer volume.

It is an object of the present invention to provide a way to design a more efficient compact two-stage pulse tube refrigerator by using inter-phase control in combination with a buffer volume.

It is an object of the present invention to minimize vibration in a cryogenic refrigerator.

It is an object of the present invention to provide increased reliability of a cryogenic refrigerator.

It is an object of the present invention to provide a buffer tank to compensate for flow differences between the pulse tubes of the first and second stages.

It is an object of the present invention to reduce the number of regenerators is from four to two and the number of pulse tubes from four to two.

It is an object of the present invention to use four-valve control in combination with inter-phase control so the valve timing is the same for each stage.

SUMMARY OF THE INVENTION

The present invention addresses how a pulse tube refrigerator can be effectively and efficiently incorporated in a cryopump. The present invention addresses issues of compactness of the expander, low vibration, high reliability, and a preference for the valve mechanism to be on the bottom or side of the cryopump.

Refrigerators of the present invention can be adapted to cooling cryopump panels at two different temperatures in a way that is more compact and efficient than prior art pulse tubes. One very important attribute is the option of adding a buffer tank with minimal volume to the inter-phase connection to compensate for flow differences between the two stages of the pulse tube.

A first difference between the present invention and the prior art is the present invention's ability to design the first and second stages to use differing amounts of gas, whereas the prior art have no design flexibility.

A second difference between the present invention and the prior art is that certain embodiments of the present invention includes a buffer volume that is shared between the pulse tubes of the first and second stages, whereas the prior art describes a double orifice control including a much larger buffer volume.

In certain embodiments of the present invention the flow in the two stages is balanced and the required buffer volume is 0.

DESCRIPTION OF THE INVENTION

Figure 1:
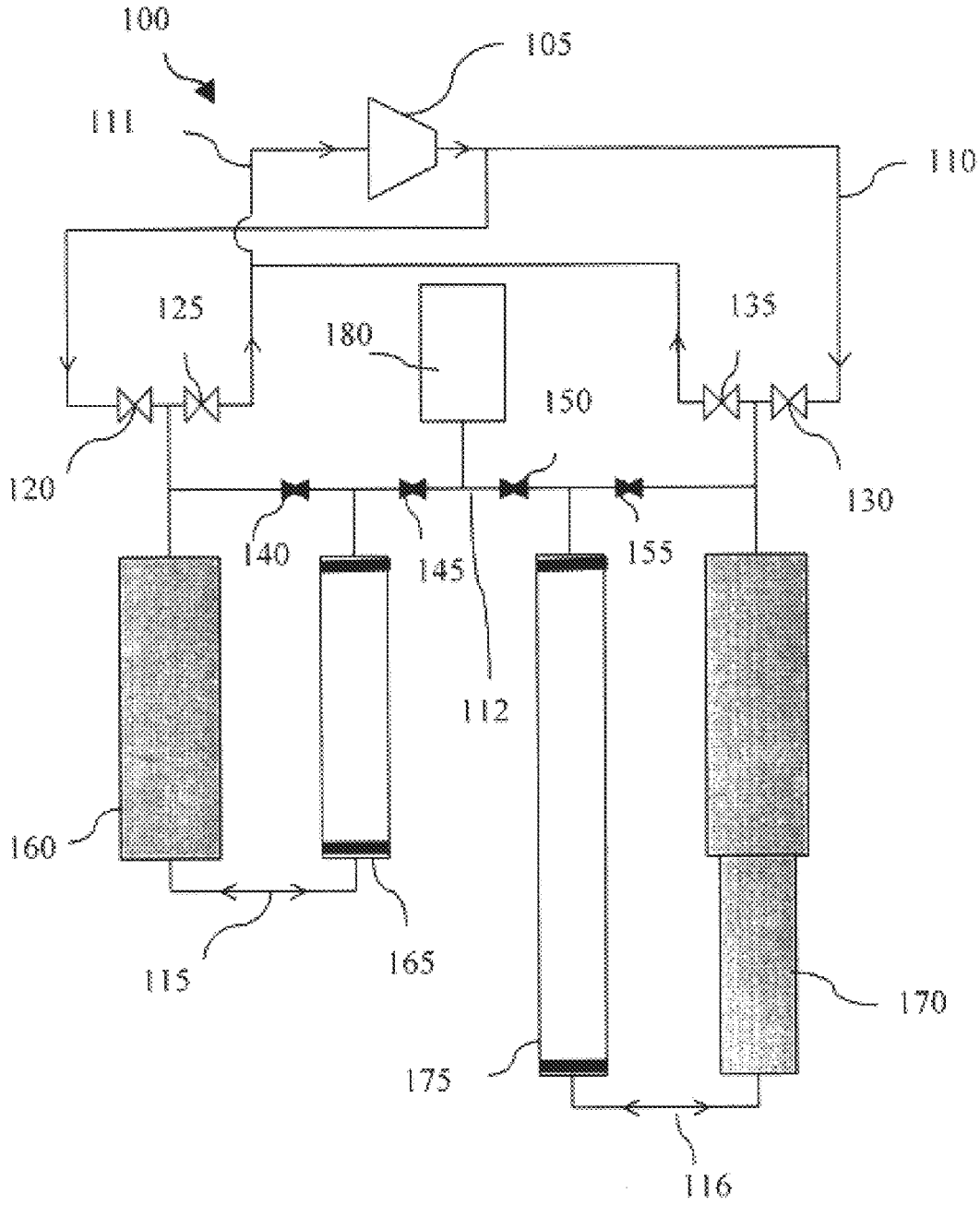
FIGS. 1 to 12 depict schematics of two stage pulse tube refrigerators that embody twelve means of inter-phase control per the present invention.

The present invention is a series of designs for two stage inter-phasing pulse tube refrigerators for use as efficient and reliable cryocoolers. Two separate refrigeration heat stations are enabled by the inclusion of two pulse tubes of differing dimensions. The various designs include inter-phasing schemes between the two stages of the refrigerator, such as passive and active inter-phases. Further, each design may or may not include a single shared buffer volume to compensate for flow imbalances between the two pulse tubes.

The following descriptions apply to the components that are common to all of the embodiments.

Compressor 105 is an element serving to apply pressure to the working gas (Helium) within the pulse tube refrigerator. The closed loop nature of pulse tube refrigerator sees compressor 105 receiving low-pressure gas from the system and returning the gas in high-pressure form. Optimum system parameters find compressor 105 operating with a high pressure of about 280 psig and a return pressure of about 100 psig.

Valve 120, valve 125, valve 130, and valve 135 are active valves that direct the flow of gas to the various elements of the pulse tube refrigerator by cycling between on and off positions during the operation of the two stages of pulse tube refrigerator 180° out of phase. Valve 120, valve 125, valve 130, and valve 135 are likely to be included in a conventional rotary valve which is powered by a standard motor manufactured by Warner Electric that typically operates at 72 RPM on 60 Hz and 60 RPM on 50 Hz. Valve 120 is a high-pressure gas supply valve, valve 125 is a low-pressure gas return valve, valve 130 is a high-pressure gas supply valve, and valve 135 is a low-pressure gas return valve. The ports in these valves are large relative to the flow impedances in the regenerator and the bypass channel.

Regenerator 160 is the first stage regenerative heat exchanger, the size and dimension of which are largely dependent upon the application and demands for which the pulse tube refrigerator is designed. Regenerator 160 functions to remove heat from the incoming gas passing through it and returns heat to the out flowing gas. It may be cylindrical in overall shape and include one or more axial passage(s) containing a matrix, i.e., an open, thermally conductive structure with many flow paths and large surface area for transfer of heat to and from the working gas. Regenerator 160 may be made of any material of high thermal conductivity. In one example, regenerator 160 is filled with copper or bronze screen disks.

Pulse tube 165 is the first stage pulse tube, the size and dimensions of which are largely dependent upon the application and demands for which pulse tube refrigerator 100 is designed. Pulse tube 165 is a thin-walled stainless steel tube brazed at each end with mesh copper screen disks, which serve to both exchange heat and smooth the flow of gas into a laminar profile (see U.S. patent application Ser. No. 09/838,840, the disclosure of which is incorporated herein by reference.) Taken as an assembly, regenerator 160 and pulse tube 165 will be referred to as the first stage pulse tube, PT1.

Regenerator 170 is the second stage regenerative heat exchanger, the size and dimensions of which are largely dependent upon the application and demands for which the pulse tube refrigerator is designed. Regenerator 170 may include two stages, in which case the upper stage may be filled with copper or bronze screen disks and the lower stage filled with lead shot.

Pulse tube 175 is the second stage pulse tube and is similar to pulse tube 165. The dimensions of pulse tube 175 depend on design optimization considerations of the pulse tube refrigerator, i.e. the particular application for which the pulse tube refrigerator is designed. Taken as an assembly, regenerator 170 and pulse tube 175 will be referred to as the second stage pulse tube, PT2.

High pressure piping 110 is a series of gas lines connecting the high pressure side of compressor 105 to the hot ends (tops) of regenerator 160 through valve 120 and regenerator 170 through valve 130. Piping 110 may be flexible stainless steel hose, SS tubing, soft copper tubing, or a variety of other materials, including holes drilled in a manifold and a group of plates with appropriate flow paths for heat transfer purposes, whose size and dimensions are dependent upon the application. Low pressure piping 111 is a series of gas lines similar to high pressure piping 110 that connects the leads from the hot ends of regenerator 160 through valve 125, and regenerator 170 through valve 135, to the low pressure side of compressor 105.

Piping 115 and piping 116 are connections between the bottoms (cold ends) of regenerator 160 and pulse tube 165, and between the cold ends of regenerator 170 and pulse tube 175, respectively. Piping 115 and piping 116 may be stainless steel or soft copper tubing, holes drilled in a heat station and/or a group of plates with appropriate holes.

The two stages of a pulse tube refrigerator are operated 180° out of phase via the action of valves 120, 125, 130, 135, and compressor 105. Compressor 105 pressurizes the gas and valves 120, 125, 130, and 135 generate an oscillating gas flow in the rest of the system. Although helium is the working gas in the present invention, the working gas may be selected arbitrarily depending on desired cryogenic temperature, desired output, or the like. For example, the working gas may be nitrogen, argon, hydrogen, or a mixture thereof with helium included. This gas flow carries heat away from the low temperature points (the cold end of pulse tube 165 and the cold end of pulse tube 175). Pressure is generated in the pulse tube of each stage 180° out of phase by the cycling of valves 120, 125, 130, and 135.

Although the refrigeration power of a pulse tube refrigerator according to the present invention depends largely on the dimensions of the elements included in the system, i.e. the size of pulse tube 165 and the size of pulse tube 175, typical temperatures achievable with a pulse tube refrigerator may be as low as 20 K for the first stage and 3.0 K for the second stage.

THE FOLLOWING DESCRIPTIONS APPLY TO SEVERAL OF THE EMBODIMENTS

Passive flow restrictors, including FR 140, FR 145, FR 150, and FR 155, may be capillary tubes, needle valves, or orifices. With the exception of an orifice (a small hole in a plate), flow restrictors are characterized by different flow characteristics in one direction than the other. It is desirable that the same mass of gas flows into and out of each pulse tube, as the flowing gas is used to compress a gas piston within each pulse tube. If the flow of gas into and out of a pulse tube is not equal, more gas may enter the top (warm end) of a pulse tube, in which case warm gas is pushed down to the bottom of the pulse tube, (or vice versa), resulting in a significant loss. Each flow restrictor of the present invention may comprise two oppositely oriented needle valves. In cases where there are active valves in the bypass channel they have flow impedances that are similar to, but less than, the passive flow restrictors.

Buffer tank 180 is a reservoir functioning to store gas and to compensate for gas flow imbalances between PT1 and PT2 that result from their different volumes and temperatures.

Embodiments one, two, five, six, seven, and eight have a bypass channel 112 which connects the hot ends of regenerators 160 and 170, to the hot ends of pulse tubes 165 and 175. Embodiments one, two, six, and eight have a buffer tank 180 connected to bypass channel 112 between the hot ends of pulse tubes 165 and 175. Flow between the components through bypass channel 112 is controlled by at least three of fixed restrictors 140, 145, 150, 155, and active valves 205, 210, 505, 510.

Pulse tubes with inter-phase control that have been sized so a buffer tank is not needed have limited volume and temperature ratios to operate satisfactorily. Many conventional systems without inter-phase control use a buffer volume for each stage, adding bulk and size to the system. The present invention provides the option of compensating for flow imbalances between two differing size pulse tubes with a single BT 180 and the inclusion of flow restricting elements FR 145 and FR 150, or active valves 205 and 210, thus achieving a more compact design. Further, since pulse tube 165 and pulse tube 175 achieve the expansion and compression of working gas via columns of gas acting as gas pistons, as opposed to the mechanical pistons included in Stirling and Gifford McMahon systems, the elimination of moving parts in the cold ends of pulse tube 165 and pulse tube 175 is facilitated, which greatly reduces the level of vibration generated by the pulse tube refrigerator. Pulse tube refrigerators in accordance with embodiments one, three, five, six, nine and ten lend themselves nicely to inline construction with remote hot ends. This configuration is suited for cryopump applications particularly well: the exclusion of active valves to connect the hot ends of pulse tube 165, pulse tube 175, and possibly BT 180 is desirable due to the impracticality of including valves at the far end of an inline pulse tube i.e. a pulse tube that is an extension of the regenerator (see U.S. Pat. No. 5,107,683).

First Embodiment, (FIG. 1, Table 1)

The elements of pulse tube refrigerator 100 that are unique to this embodiment are interconnected as follows: The hot ends of regenerator 160 and pulse tube 165 are connected via bypass channel 112 and passive orifice FR 155. The hot ends of pulse tube 165 and pulse tube 175 are connected via bypass channel 112 and passive orifices FR 145 and FR 150. BT 180 is connected to bypass channel 112 between passive orifices FR 145 and FR 150.

At the start of a cycle (0°), the pressure in the pulse tubes is at their maximum and minimum values. It is assumed that the first stage is near the low pressure in piping 111 and the second stage is near the high pressure in piping 110. Table 1 shows the valve positions for one cycle which is taken as 360° and in real time is typically about 500 ms. With reference to Table 1 valves 120, 125, 130, and 135 are closed for about 45°. During this period gas flows through bypass channel 112 from the second stage to the first stage. If there is an imbalance between the amount of gas leaving the second stage and entering the first stage the difference is made up by gas flowing in or out of BT 180. At about 45° valve 120 and valve 135 open and remain open up to 180°. During this period high-pressure working gas is supplied to the first stage through the high-pressure supply valve 120 and gas flows from the second stage through valve 135 to return to the compressor at low pressure. At 180° high-pressure valve 120 and low-pressure valve 135 close and all of the valves remain closed for the next 45°. The flow process of the first 45° is repeated in reverse. High-pressure valve 130 and low-pressure valve 125 then open at about 225°, causing high-pressure working gas to be supplied to the second stage through valve 130 while gas returns from the first stage to low pressure through valve 125. Interconnecting the pulse tubes to partially equalize the pressure before opening the valves to the compressor reduces the amount of gas flow through the compressor and improves the efficiency. The buffer tank 180 compensates for an imbalance in the amount of gas that is exchanged between the two stages. The flow imbalance may be due to the two stages having different volumes or having gas at different densities. The amount of gas in each stage depends on the temperatures, which depend on heat loads, so it will change during operation of the system. Compressor pressures also change during operation as the temperatures in the pulse tube change.

Figure 2:
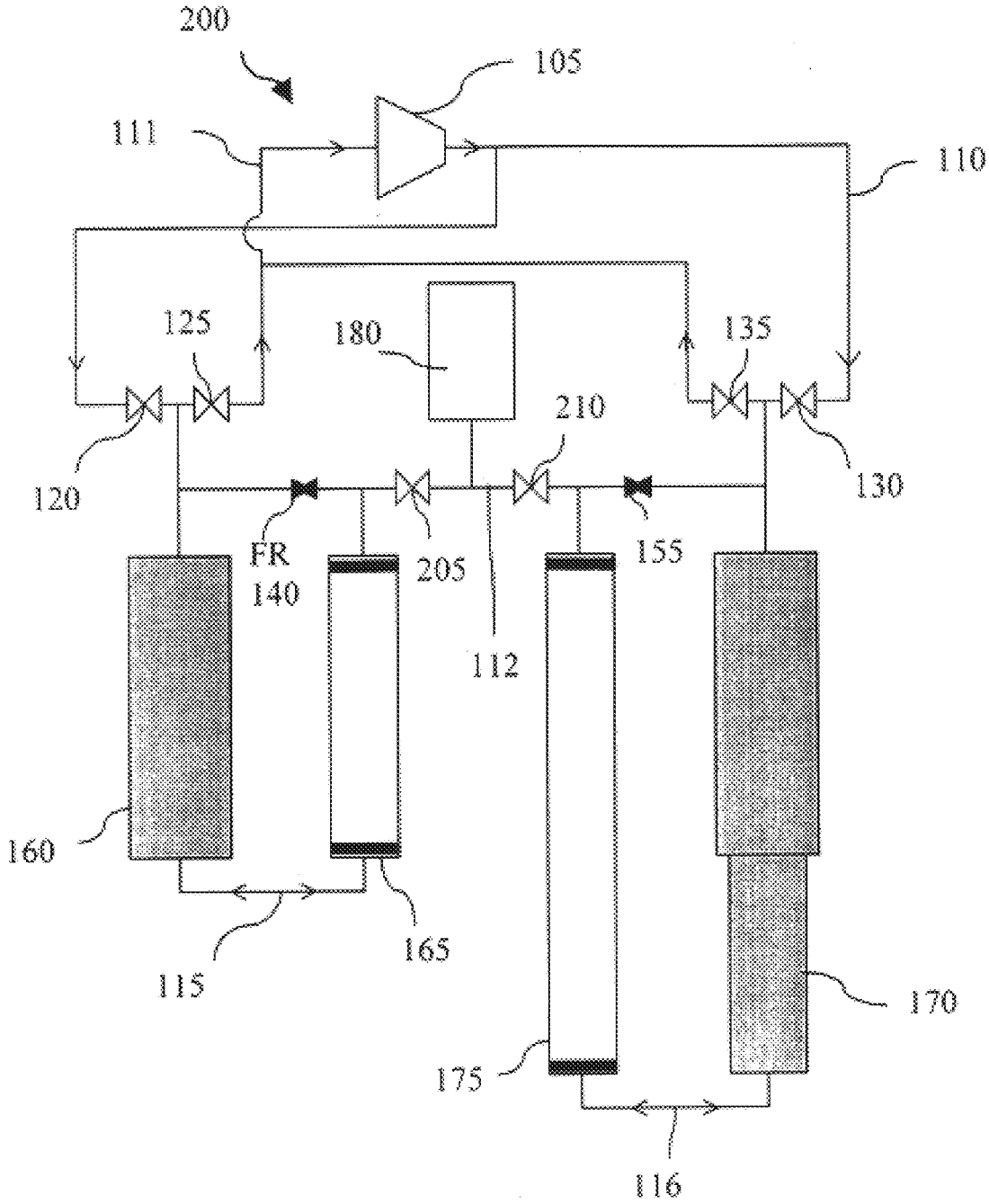

Second Embodiment, (FIG. 2, Table 2)

The second embodiment differs from the first in that fixed restrictor valves FR 145 and FR 150 are replaced by active valves 205 and 210 respectively. By cycling between on and off positions they either permit or prevent the flow of gas between the hot end of pulse tube 165 and BT 180 and between the hot end of pulse tube 175 and BT 180, respectively.

The operation of pulse tube refrigerator 200 is similar to that of pulse tube refrigerator 100, with the exception that active valves 205 and 210 cycle between on and off positions 180° out of phase as shown in Table 2. As in all of the cases presented here the initial pressures in the pulse tubes are at their maximum and minimum values. The two stages are interconnected for about 45° then they are separately pressurized or depressurized by flow from and to the compressor. Valve 205 and valve 210 facilitate a more efficient refrigeration cycle than passive orifices FR 145 and FR 150, because they block the flow of gas between the two pulse tubes when they are closed thus preventing bypassing of gas from high to low pressure through 112.

Figure 3:
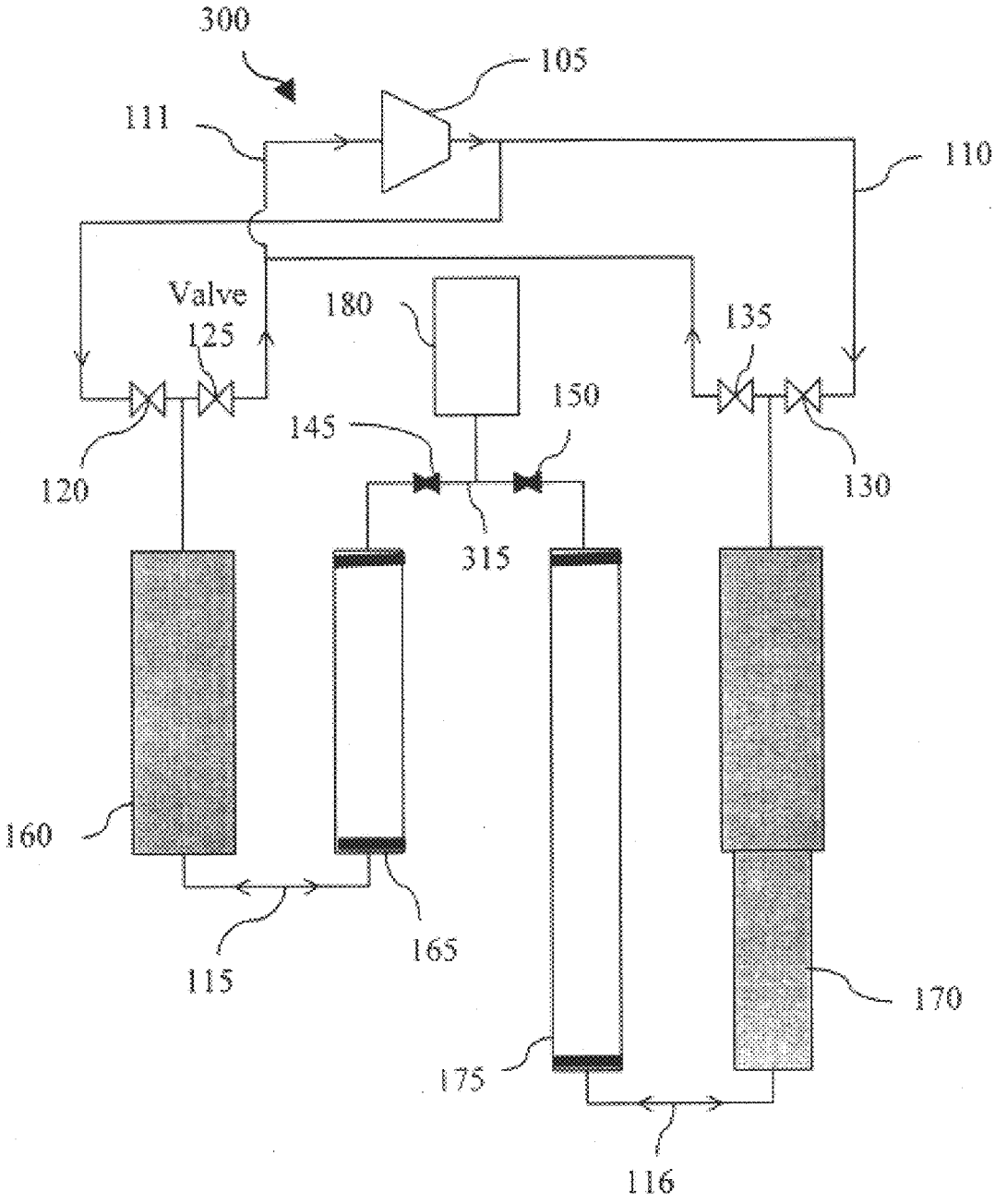

Third Embodiment, (FIG. 3, Table 1)

The elements of pulse tube refrigerator 300 are interconnected similar to refrigerator 100 with the exception that bypass channel 212 is replaced by 315 which does not extend to the hot ends of regenerators 160 and 170. FR 145 and FR 150 are flow restrictors located along bypass channel 315, which connects the hot ends (tops) of pulse tube 165 and pulse tube 175. Flow restrictors FR 140 and FR 155 are not included.

The operation of pulse tube refrigerator 300 is characterized by a passive inter-phase and a buffer volume, and is similar to that of pulse tube refrigerator 100. Cycle timing is about the same as pulse tube refrigerator 100 as listed in Table 1. The present embodiment is advantageous in that it avoids a direct flow of gas, which may occur, from high to low pressure, and it avoids unfavorable circulation of gas between the pulse tube and regenerator. On the other hand the efficiency is reduced by not having valves between the top of the regenerator and the top of the pulse tube.

Figure 4:
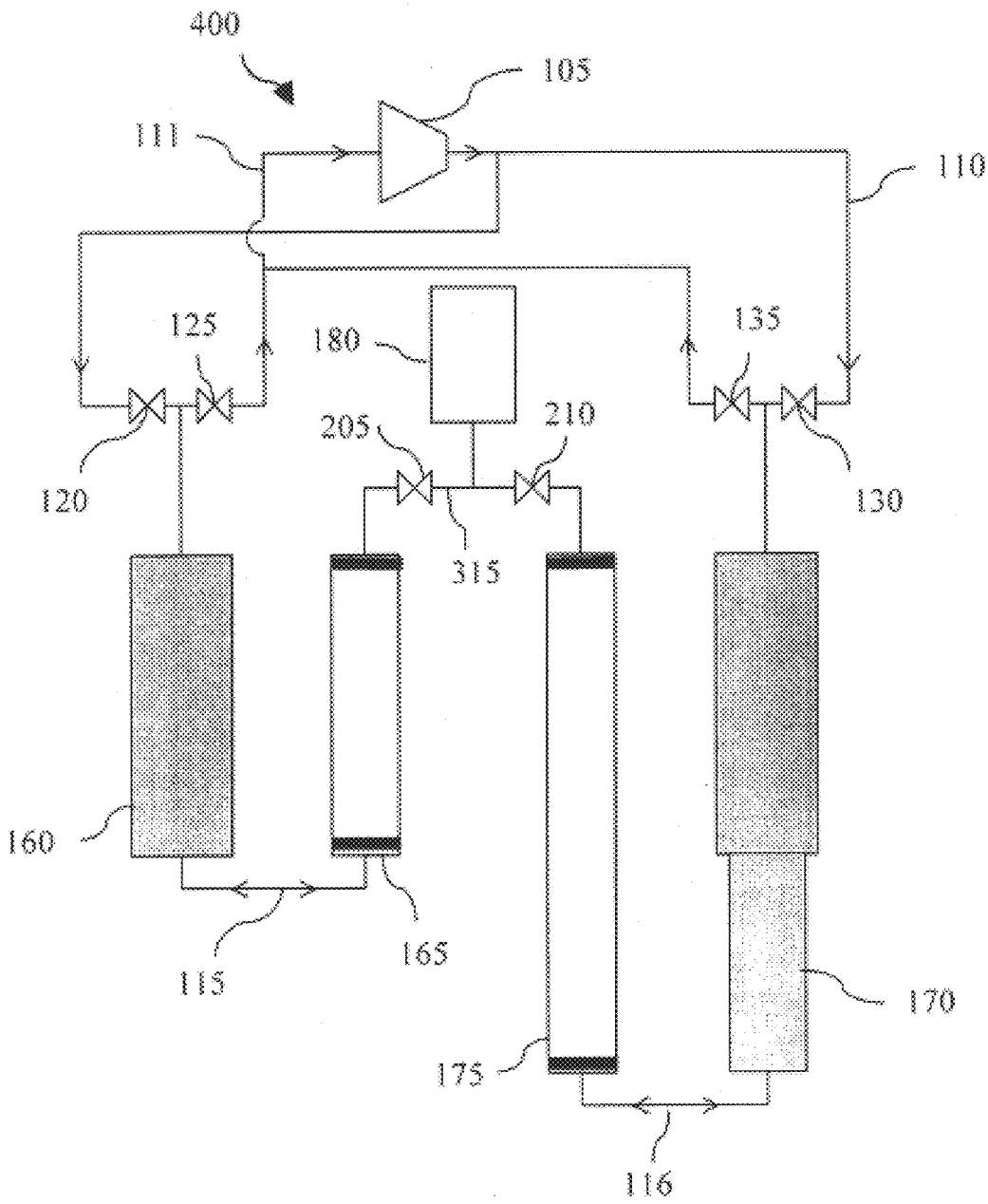

Fourth Embodiment, (FIG. 4, Table 2)

The elements of pulse tube refrigerator 400 are interconnected similar to refrigerator 300 except that flow restrictors FR 145 and FR 150 are replaced with active valves 205 and 210 respectively. The active valves cycle between on and off positions and in so doing, either permit or prevent the flow of gas between the hot end of pulse tube 165 and BT 180 and between the hot end of pulse tube 175 and BT 180, respectively.

The operation of pulse tube refrigerator 400 is characterized by an active inter-phase and a buffer volume, and is similar to pulse tube refrigerator 300, with the exception that the inter-phase is active. As opposed to pulse tube refrigerator 300, inter-phasing of pulse tube refrigerator 400 is accomplished by the 180° out-of-phase cycling of active valve 205 and valve 210, as opposed to passive inter-phase of pulse tube refrigerator 300 using flow restricting orifices. The cycling of valve 205 and valve 210 with respect to the cycling of valves 120, 125, 130, and 135 is detailed in Table 2. Cycle timing is about the same as pulse tube refrigerator 200. The present embodiment is advantageous in that it provides better control of the flow between the two pulse tubes thus improving the efficiency. It avoids a direct flow of gas, which may occur, from high to low pressure, and it avoids unfavorable circulation of gas between the pulse tube and regenerator.

Figure 5:
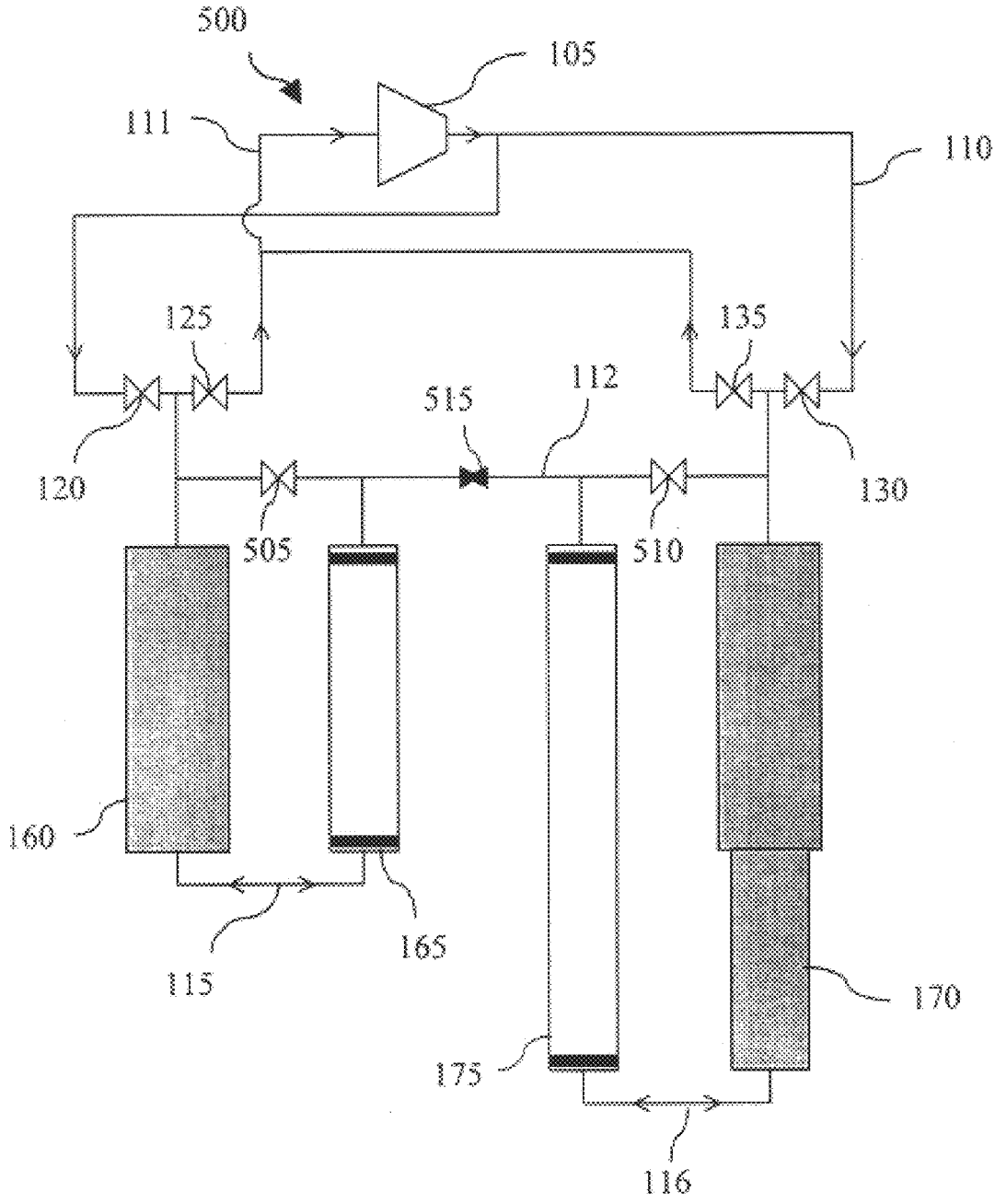

Fifth Embodiment, (FIG. 5, Table 3)

Valve 505 and valve 510 are active valves that cycle between on and off positions, alternately permitting and preventing the flow of gas between the hot ends of regenerator 160 and pulse tube 165, and between the hot ends of regenerator 170 and pulse tube 175, respectively.

FR 515 is a flow restrictor similar to FR 140, FR 145, FR 150, and FR 150, serving to restrict the flow of gas between the hot ends of pulse tube 165 and pulse tube 175.

The elements of pulse tube refrigerator 500 are interconnected as follows: The hot ends of regenerator 160 and pulse tube 165 are connected via bypass channel 212 and valve 505. The hot ends of pulse tube 165 and pulse tube 175 are connected via bypass channel 212 and passive orifice FR 515. The hot end of pulse tube 175 and regenerator 170 are connected via bypass channel 212 and valve 510.

The operation of pulse tube refrigerator 500 is characterized by a passive inter-phase and active valves communicating the hot ends of the pulse tube and regenerator of each stage. Additionally, pulse tube refrigerator 500 is characterized by the exclusion of a buffer volume to compensate for flow differences between pulse tube 165 and pulse tube 175, requiring a closer balance in flow between the two stages to have good efficiency. The exclusion of a buffer volume achieves a more compact design. The cycling of the six active valves is outlined below in Table 3. The flow pattern is similar to embodiment 1, Table 1, except there is no buffer tank and valves 505 and 510 are active. This improves the ability to optimize the flow of gas to the top of each pulse tube to maximize the cooling that is produced.

Figure 6:
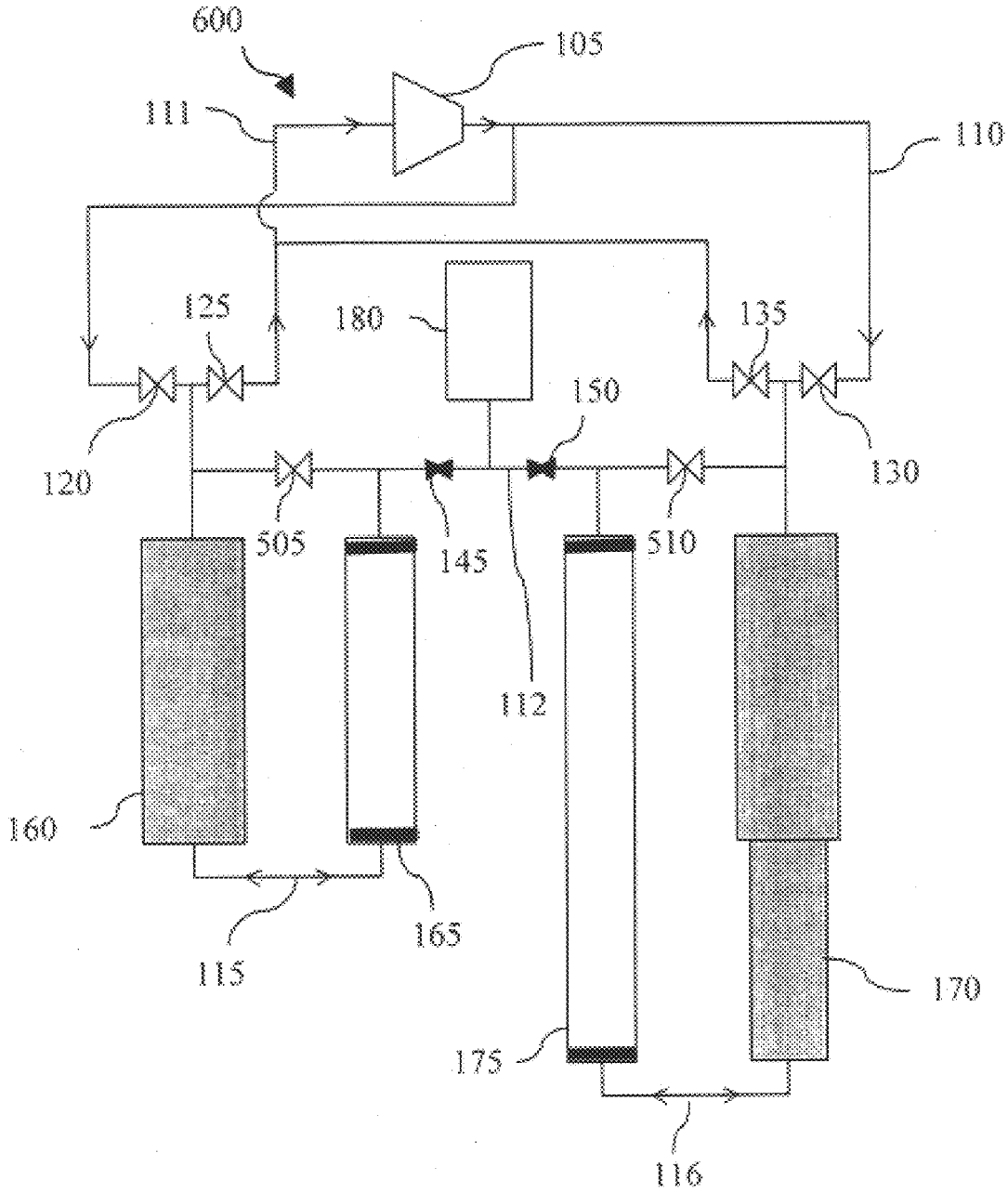

Sixth Embodiment, (FIG. 6, Table 3)

Valve 505 and valve 510 are active valves that cycle between on and off positions, alternately permitting and preventing the flow of gas between the hot ends of regenerator 160 and pulse tube 165, and between the hot ends of regenerator 170 and pulse tube 175, respectively.

FR 145 and FR 150 are passive orifices similar to FR 140, FR 145, FR 150, and FR 150, serving to restrict the flow of gas between BT 180 and the hot end of pulse tube 165, and between BT 180 and the hot end of pulse tube 175, respectively.

The elements of pulse tube refrigerator 600 are interconnected as follows: The hot ends of regenerator 160 and pulse tube 165 are connected via bypass channel 212 and valve 505. The hot ends of pulse tube 165 and pulse tube 175 are connected via bypass channel 212 and passive orifices FR 145 and FR 150. The hot ends of pulse tube 175 and regenerator 170 are connected via bypass channel 212 and valve 510. BT 180 is connected to the hot end of pulse tube 165 via bypass channel 212 and FR 145, and to the hot end of pulse tube 175 via bypass channel 212 and FR 150.

The operation of pulse tube refrigerator 600 is characterized by a passive inter-phase, a buffer volume, and active valves communicating the hot ends of the pulse tube and regenerator of each stage. The operation of pulse tube refrigerator 600 is similar to the operation of pulse tube refrigerator 500, with the exception that there is a buffer volume, BT 180, which compensates for an imbalance in the amount of gas that is exchanged between the two stages. The cycling of the six active valves is outlined below in Table 3.

Figure 7:
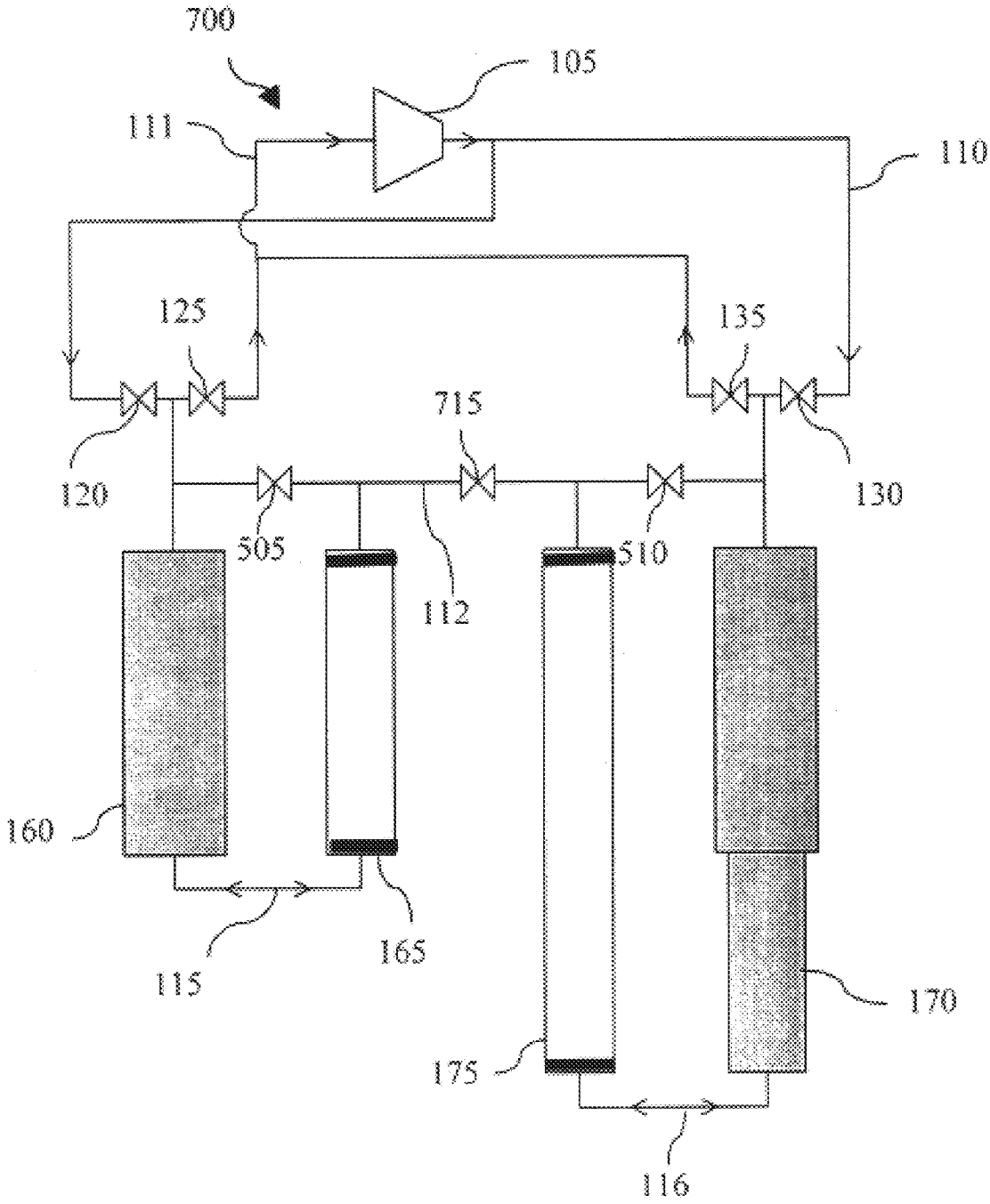

Seventh Embodiment, (FIG. 7, Table 4)

The elements of pulse tube refrigerator 700 are interconnected similar to refrigerator 500 except that flow restrictor FR 515 is replaced with active valve 715 and 210 respectively. The active valve cycles between on and off positions and in so doing, either permits or prevents the flow of gas between the hot end of pulse tube 165 and pulse tube 175.

Valve 505, and valve 510, are active valves that cycle between on and off positions, alternately permitting and preventing the flow of gas between the hot ends of regenerator 160 and pulse tube 165, and between the hot ends of pulse tube 175 and regenerator 170, respectively.

The elements of pulse tube refrigerator 700 are interconnected as follows: The hot ends of regenerator 160 and pulse tube 165 are connected via bypass channel 212 and active valve 505. The hot ends of pulse tube 165 and pulse tube 175 are connected via bypass channel 212 and active valve 715. The hot ends of pulse tube 175 and regenerator 170 are connected via bypass channel 212 and valve 510.

The operation of pulse tube refrigerator 700 is characterized by an active inter-phase, active valves connecting the hot ends of the pulse tube and regenerator of each stage, and the lack of a buffer volume. The operation of pulse tube refrigerator 700 is similar to the operation of pulse tube refrigerator 500; with the exception that active valve 715 serves as the inter-phase mechanism instead of a flow-restricting orifice. The cycling of the six active valves of pulse tube refrigerator 700 is outlined in Table 4 below.

Figure 8:
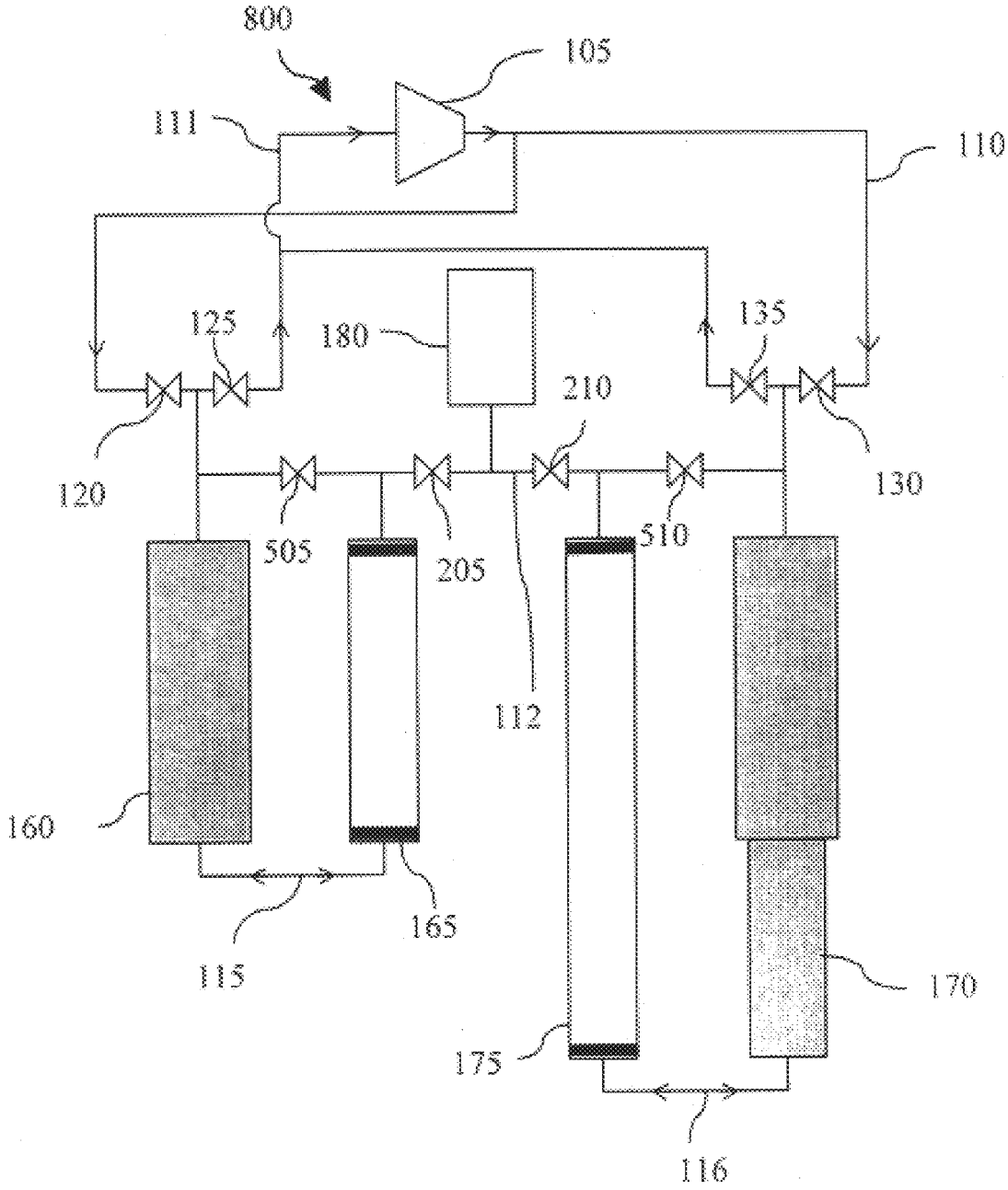

Eighth Embodiment, (FIG. 8, Table 5)

Valve 505, valve 510, valve 205, and valve 210 are active valves that cycle between on and off positions. Valve 505 and valve 510 alternately permit and prevent the flow of gas between the hot ends of regenerator 160 and pulse tube 165, and between the hot ends of regenerator 170 and pulse tube 175, respectively. Valve 205 and valve 210 alternately permit and prevent the flow of gas between BT 180 and the hot end of pulse tube 165, and between BT 180 and the hot end of pulse tube 175, respectively.

The elements of pulse tube refrigerator 800 are interconnected as follows: The hot ends of regenerator 160 and pulse tube 165 are connected via bypass channel 212 and valve 505. The hot ends of pulse tube 165 and pulse tube 175 are connected via bypass channel 212, valve 205, and valve 210. The hot ends of pulse tube 175 and regenerator 170 are connected via bypass channel 212 and valve 510.

The operation of pulse tube refrigerator 800 is characterized by an active inter-phase, a buffer volume, and active valves that communicate the hot ends of the pulse tube and regenerator of each stage. The operation of pulse tube refrigerator 800 is similar to the operation of pulse tube refrigerator 600, with the exception that BT 180 is connected to the hot end of pulse tube 165 via piping 112 and an active valve 205 and, likewise, BT 180 is connected to the hot end of pulse tube 175 via high pressure piping 112 and an active valve 210, as opposed to the passive inter-phase of pulse tube refrigerator 600, in which flow restricting orifices are disposed along piping 112 between BT 180 and the hot ends of the pulse tubes. The cycling of the eight active valves of pulse tube refrigerator 800 is seen in Table 5.

Figure 9:
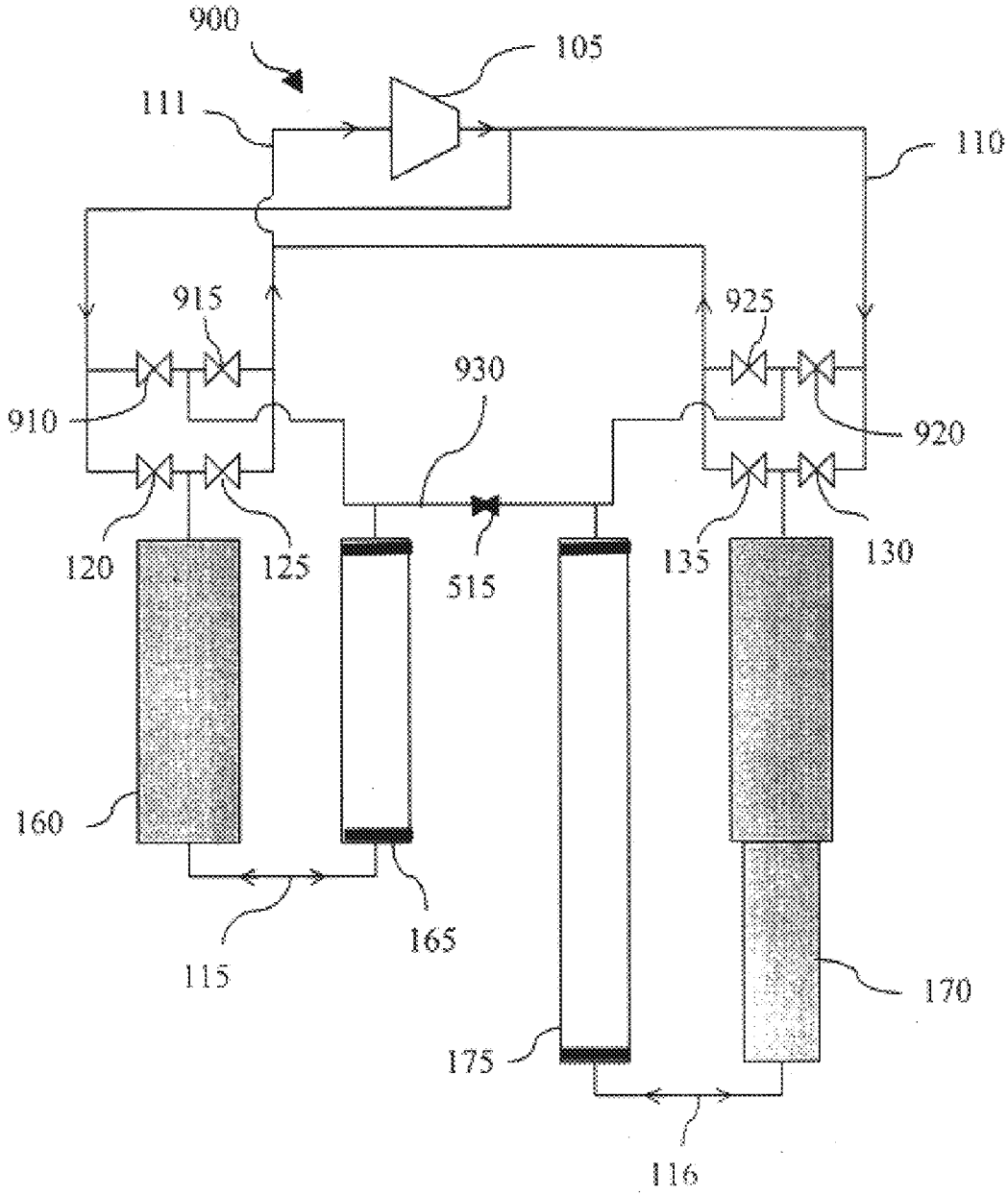

Ninth Embodiment, (FIG. 9, Table 6)

FIG. 9 is a schematic of a pulse tube refrigerator 900, and includes compressor 105, piping 110, piping 111, valve 120, valve 125, valve 130, valve 135, regenerator 160, pulse tube 165, regenerator 170, and pulse tube 175, as described in the first embodiment. Pulse tube refrigerator 900 also includes an FR 515, a valve 910, a valve 915, a valve 920, and a valve 925.

Valve 910, valve 915, valve 920, and valve 925 are active valves that cycle between on and off positions. Valve 910, valve 915, valve 920, and valve 925 may be included in a single rotary valve powered by a standard motor manufactured by Warner Electric that typically operates at 72 RPM on 60 Hz and 60 RPM on 50 Hz. Valve 910 is a high-pressure gas supply valve, valve 915 is a low-pressure gas return valve, valve 920 is a high-pressure gas supply valve, and valve 925 is a low-pressure gas return valve.

FR 515 is a passive orifice similar to FR 140, FR 145, FR 150, and FR 150, serving to restrict the flow of gas between the hot ends of pulse tube 165 and pulse tube 175.

The elements of pulse tube refrigerator 900 are interconnected as follows: compressor 105 is connected to the hot end of regenerator 160 via high pressure piping 110, valve 120, valve 125, and low pressure piping 111. Compressor 105 is connected to the hot end of pulse tube 165 via bypass channel 930, valve 910, and valve 915. Compressor 105 is connected to the hot end of regenerator 170 via high-pressure piping 110, valve 130, valve 135, and low pressure piping 111. Compressor 105 is connected to the hot end of pulse tube 175 via bypass channel 930, valve 920, and valve 925. The hot ends of pulse tube 165 and pulse tube 175 are connected via bypass channel 930 and passive orifice FR 515.

In operation, pulse tube refrigerator 900 includes a passive inter-phase between the first and second stages, namely, the flow-restricting element FR 515. Further, pulse tube refrigerator 900 utilizes, in addition to active valves 120, 125, 130, and 135, which control the flow of gas into and out of regenerator 160 and regenerator 170, active valves 910, 915, 920, and 925 to control the flow of gas into and out of pulse tube 165 and pulse tube 175. The inclusion of valve 910, valve 915, valve 920, and valve 925 increases the efficiency of pulse tube refrigerator 900 when compared to the previous eight embodiments. The cycling of valve 910, valve 915, valve 920, and valve 925 allow more refrigeration to be achieved, by increasing the area under the curve in the system P-V (pressure-volume) diagram, and hence the work being done, at the cold end of each pulse tube 165 and 175. Additionally, pulse tube refrigerator 900 does not require a bypass connection between the hot ends of the regenerator and pulse tube of both stages, further reducing the volume of gas required from compressor 105. The minimization of the required working gas volume needed to achieve desired refrigeration within pulse tube refrigerator 900 results in an increase in efficiency, as the performance of pulse tube refrigerators is inversely proportional to the power input into the system, i.e. compressor 105. The cycling of the eight active valves of pulse tube refrigerator 900 is outlined in Table 6 below.

Figure 10:
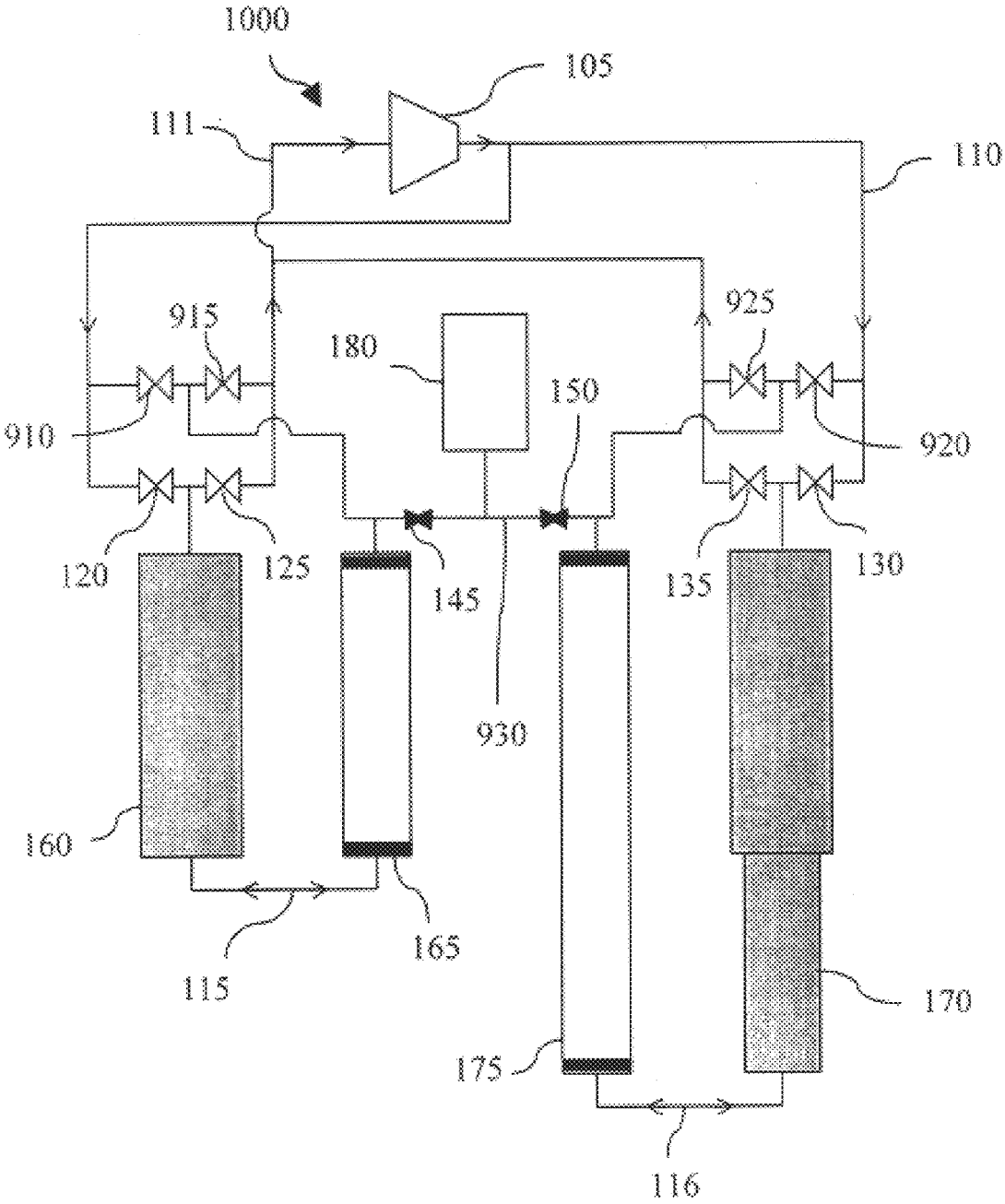

Tenth Embodiment, (FIG. 10, Table 6)

FIG. 10 is a schematic of a pulse tube refrigerator 1000. It has the same elements as refrigerator 900 except that FR 515 is replaced by passive orifices FR 145 and FR 150, with BT 180 between them. FR 145 and FR 150 are passive orifices similar to FR 140, FR 145, FR 150, and FR 150. They serve to restrict the flow of gas between the hot ends of pulse tube 165 and pulse tube 175. BT 180 serves to compensate for flow imbalances.

The elements of pulse tube refrigerator 1000 that are different from refrigerator 900 are interconnected as follows: the hot end of pulse tube 165 and BT 180 are connected via bypass channel 930 and passive orifice FR 145. The hot end of pulse tube 175 and BT 180 are connected via bypass channel 930 and passive orifice FR 150.

In operation, pulse tube refrigerator 1000 includes a passive inter-phase between the first and second stages, namely, the flow-restricting elements FR 145 and FR 150. The cycling of the eight active valves of pulse tube refrigerator 1000 is outlined in Table 6 below.

Figure 11:
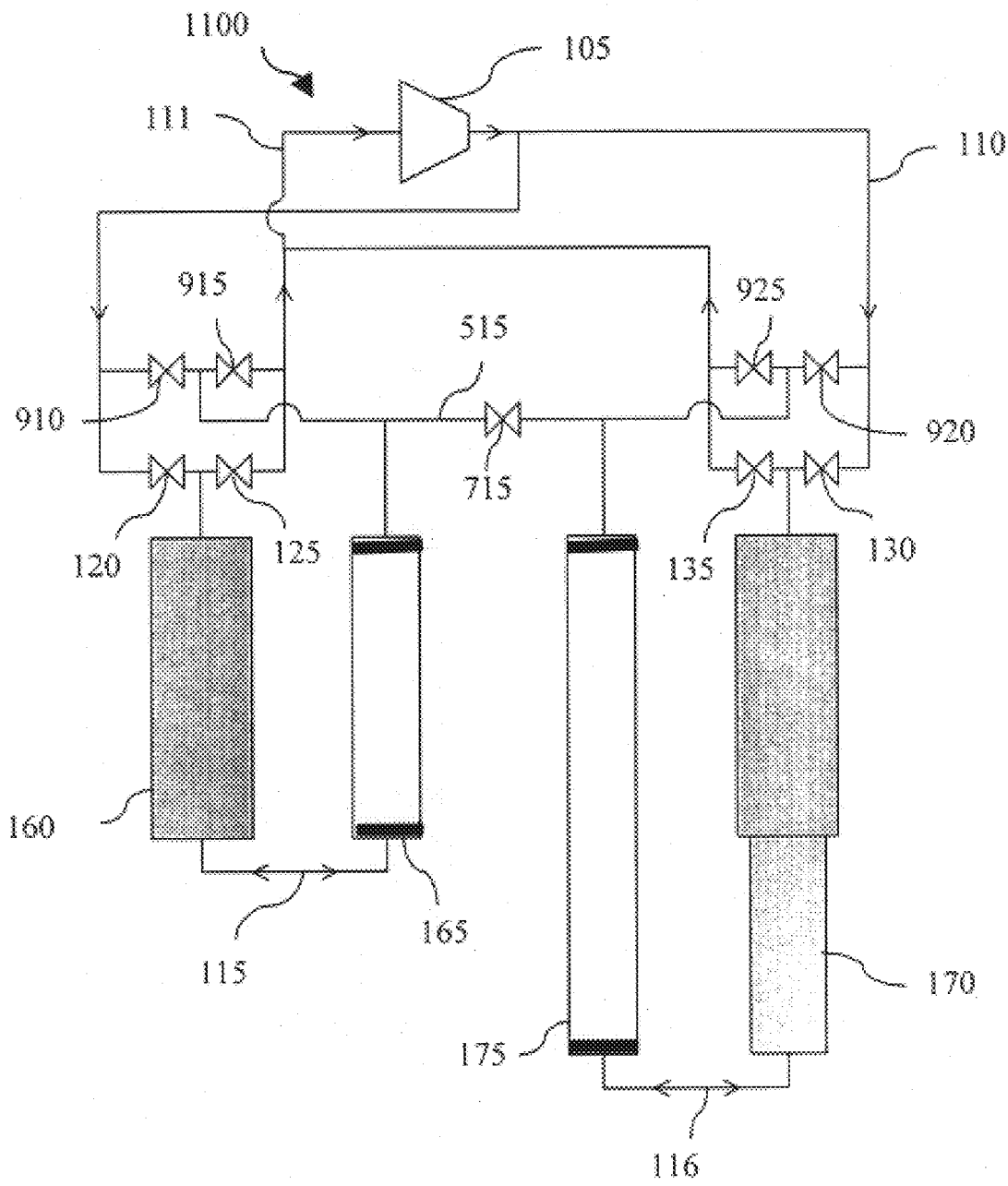

Eleventh Embodiment, (FIG. 11, Table 7)

FIG. 11 is a schematic of a pulse tube refrigerator 1100, and includes the same elements as refrigerator 900 except FR 515 is replaced with active valve 715. Valve 715 is an active valve that cycles between on and off positions and alternately permits or restricts the flow of gas between the hot ends of pulse tube 165 and pulse tube 175.

In operation, pulse tube refrigerator 1100 is characterized by an active inter-phase with no buffer volume. Pulse tube refrigerator 1100 operates similar to pulse tube refrigerator 900, with the exception that an active valve 715 cycles between an on and off position as the inter-phase mechanism, as opposed to a flow restricting orifice. The cycling of the nine active valves of pulse tube refrigerator 1100 is outlined in Table 7 below.

Figure 12:
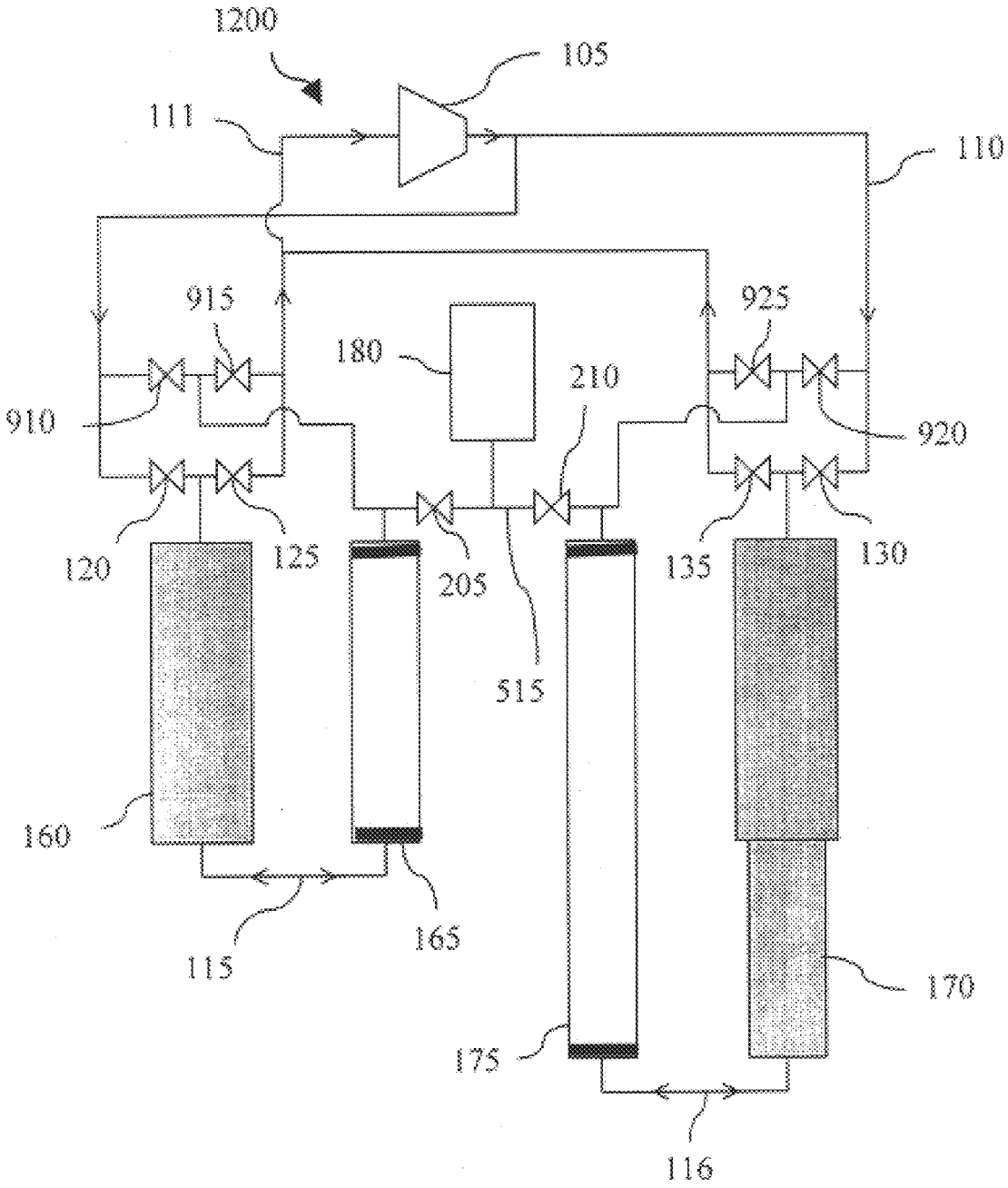

Twelfth Embodiment, (FIG. 12, Table 10)

FIG. 12 is a schematic of a pulse tube refrigerator 1200, and includes compressor 105, piping 110, piping 111, valve 120, valve 125, valve 130, valve 135, regenerator 160, pulse tube 16 regenerator 170, pulse tube 175, and BT 180, as described in the first embodiment, and valve 910, valve 915, valve 920, and valve 925, as described in the ninth embodiment. Pulse tube refrigerator 1200 differs from refrigerator 1000 in that FR 145 is replaced by active valve 205 and FR 150 is replaced by active valve 210.

Valves 205 and 210 are active valves that cycle between on and off positions and alternately permit or prevent the flow of gas between BT 180 and the hot ends of pulse tube 165 and pulse tube 175, respectively.

Tables 11 and 12 are concordances listing the component designations of components common to more than one embodiment of the invention.

It is recognized that the principles described herein can be applied to more than two pulse tube stages in order to achieve greater efficiency at the expense of increased system complexity. The following claims should be considered by one skilled in the art to encompass the concepts that are described by the specific embodiments.

TABLE 1

Valve timing chart for pulse tube refrigerator 100 and 300.

| | | | |
|---|---|---|---|
| | 120 Open | | 125 Open |
| | | | |
| | | | |
| | 135 Open | | 130 Open |
| | | | |
| | | | |

0° 45° 180° 225° 360°

TABLE 2

Valve timing chart for pulse tube refrigerator 200

| | | | |
|---|---|---|---|
| | 120 Open | | |
| | | | 125 Open |
| 205 Open | | 205 Open | |
| | 135 Open | | |
| | | | 130 Open |
| 210 Open | | 210 Open | |

0° 45° 180° 225° 360°

TABLE 3

Valve timing chart for pulse tube refrigerator 400

| | | | |
|---|---|---|---|
| | 120 Open | | |
| | | | 125 Open |
| 405 Open | | 405 Open | |
| | 135 Open | | |
| | | | 130 Open |
| 410 Open | | 410 Open | |

0° 45° 180° 225° 360°

TABLE 4

Valve timing chart for pulse tube refrigerator 500

| | | | |
|---|---|---|---|
| | 120 Open | | |
| | | | 125 Open |
| | 505 Open | | 505 Open |
| | 135 Open | | |
| | | | 130 Open |
| | 510 Open | | 510 Open |

0° 45° 180° 225° 360°

TABLE 5

Valve timing chart for pulse tube refrigerator 600

| | | | |
|---|---|---|---|
| | 120 Open | | |
| | | | 125 Open |
| | 605 Open | | 605 Open |
| | 135 Open | | |
| | | | 130 Open |
| | 610 Open | | 610 Open |

0° 45° 180° 225° 360°

TABLE 6

Valve timing chart for pulse tube refrigerator 700

| | | | | | | | | | | |
|---|---|---|---|---|---|---|---|---|---|---|
| | | 120 Open | | | | | | | | |
| | | | | | | | | 125 Open | | |
| | | 705 Open | | | | | | 705 Open | | |
| | | 135 Open | | | | | | | | |
| | | | | | | | | | | |
| | | 710 Open | | | | | | 710 Open | | |
| 715 Open | | | | 715 Open | | | | | | |

0° 36° 72° 108° 144° 180° 216° 252° 288° 324° 360°

TABLE 7

Valve timing chart for pulse tube refrigerator 800

| | | | |
|---|---|---|---|
| | 120 Open | | |
| | | | 125 Open |
| 815 Open | | 815 Open | |
| | 805 Open | | 805 Open |
| | 135 Open | | |
| | | | 130 Open |
| 825 Open | | 825 Open | |
| | 810 Open | | 810 Open |

0° 45° 180° 225° 360°

TABLE 8
Valve timing chart for pulse tube refrigerator 900 and 1000
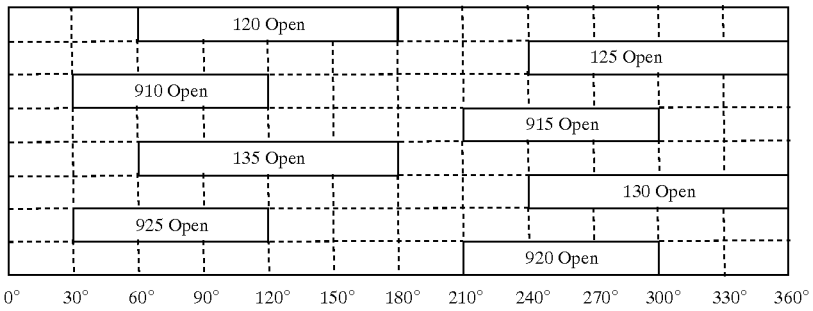
TABLE 9
Valve timing chart for pulse tube refrigerator 1100.
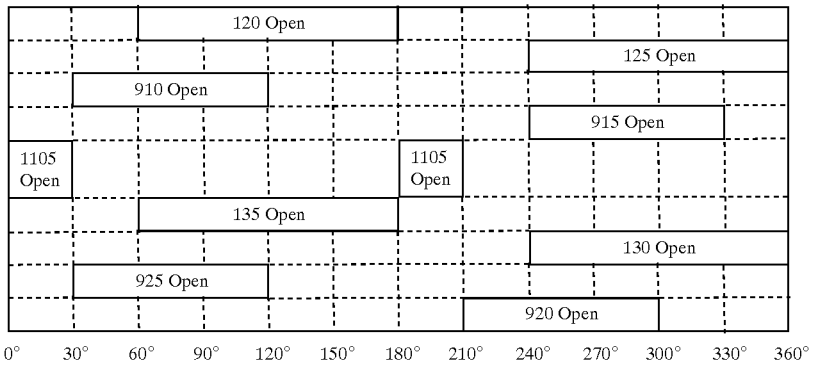
TABLE 10
Valve timing chart for pulse tube refrigerator 1200
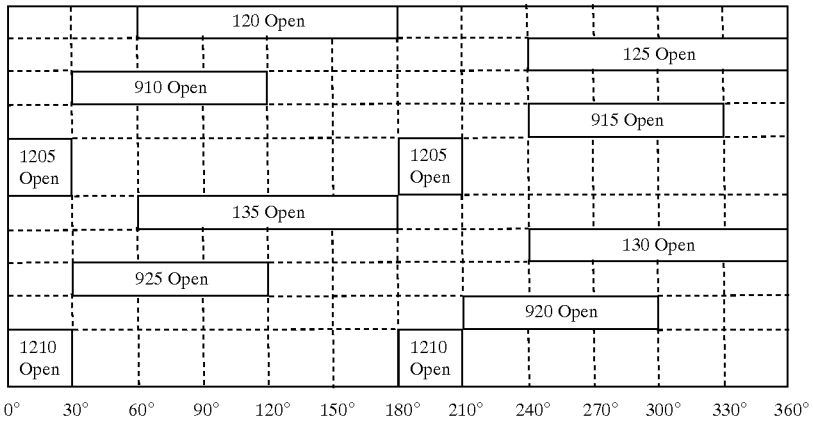

TABLE 11

Component Designation of Components Common to all Embodiments

| # | Description |
|---|---|
| 105 | Compressor - typical operating pressures are 100 psig (0.8 MPa) low pressure, 280 psig (2.0 MPa) high pressure |
| 110 | High pressure piping - connects compressor discharge to regenerator 160 through valve 120 and to regenerator 170 through valve 130 |
| 111 | Low pressure piping - connects compressor return to regenerator 160 through valve 125 and to regenerator 170 through valve 135 |
| 115 | Piping - cold connection between regenerator 160 and pulse tube 165 |
| 116 | Piping - cold connection between regenerator 170 and pulse tube 175 |
| 120 | Valve - active valve that admits high pressure gas from the compressor to warm end of regenerator 160 |
| 125 | Valve - active valve that returns low pressure gas to the compressor from the warm end of regenerator 160 |
| 130 | Valve - active valve that admits high pressure gas from the compressor to warm end of regenerator 170 |
| 135 | Valve - active valve that returns low pressure gas to the compressor from the warm end of regenerator 170 |
| 160 | Regenerator - cools gas flowing from valve 120 to cold end of first stage pulse tube 165, warms gas flowing to valve 125 from cold end of first stage pulse tube 165 |
| 165 | Pulse tube - first stage. Pumps heat from cold end to hot end by pressure cycle controlled by valves |
| 170 | Regenerator - cools gas flowing from valve 130 to cold end of second stage pulse tube 175, warms gas flowing to valve 135 from cold end of second stage pulse tube 175 |
| 175 | Pulse tube - second stage. Pumps heat from cold end to hot end by pressure cycle controlled by valves |

TABLE 12

Component Designations Common Components of Different Embodiments

| | FR, fixed restrictors | | | Active valves | | | | | | Bypass channels | | |
|---|---|---|---|---|---|---|---|---|---|---|---|---|
| | 140 | 145 | | 205 | 505 | 910 | 915 | | BT | | | |
| FIG | 155 | 150 | 515 | 210 | 510 | 920 | 925 | 715 | 180 | 212 | 315 | 515 |
| 1 | X | X | | | | | | | X | X | | |
| 2 | X | | | X | | | | | X | X | | |
| 3 | | X | | | | | | | X | | X | |
| 4 | | | | X | | | | | X | | X | |
| 5 | | | X | | X | | | | | X | | |
| 6 | | X | | | X | | | | X | X | | |
| 7 | | | | | X | | | X | | X | | |
| 8 | | | | X | X | | | | X | X | | |
| 9 | | | X | | | X | X | | | | | X |
| 10 | | X | | | | X | X | | X | | | X |
| 11 | | | | | | X | X | X | | | | X |
| 12 | | | | X | | X | X | | X | | | X |

What is claimed is:

1. A two-stage pulse tube refrigerator characterized by increased efficiencies and more compact design, comprising a first stage pulse tube a first stage regenerator;

a second stage pulse tube;

a second stage regenerator;

a compressor;

high pressure piping connecting the high-pressure end of the compressor to the hot ends of the regenerators of both stages;

low pressure piping connecting the low-pressure end of the compressor to the hot ends of the regenerators of both stages;

piping connecting the cold end of the first stage pulse tube to the cold end of the first stage regenerator;

piping connecting the cold end of the second stage pulse tube to the cold end of the second stage regenerator;

four active valves disposed along the piping between the compressor and the hot ends of the regenerators that cycle in pairs between on and off positions effectively achieving the desired gas pressure-gas displacement that is 180 degrees out of phase within the two pulse tubes;

a buffer tank connected by a bypass channel to the hot end of the first stage pulse tube and to the hot end of the second stage pulse tube; and an inter-phasing mechanism selected from active inter-phasing mechanisms and passive inter-phasing mechanisms including two valves, one in each of the lines between the hot ends of the pulse tubes and a buffer tank.

2. The two-stage pulse tube refrigerator of claim 1 wherein the high pressure piping connecting the high pressure end of the compressor to the hot ends of the regenerators of both stages also connects the high pressure end of the compressor to the hot ends of the pulse tubes.

3. The two-stage pulse tube refrigerator of claim 1 wherein the low pressure piping connecting the low pressure end of the compressor to the hot ends of the regenerators of both stages also connects the low pressure end of the compressor to the hot ends of the pulse tubes.

4. The two-stage pulse tube refrigerator of claim 1 wherein said bypass channel also connects the hot end of the first stage pulse tube to the hot end of the first stage regenerator, and connects the hot end of the second stage pulse tube to the hot end of the second stage regenerator.

5. The two-stage pulse tube refrigerator of claim 1 wherein the inter-phasing valves are active valves.

6. The two-stage pulse tube refrigerator of claim 1 wherein the passive inter-phasing mechanism is selected from the group consisting of a flow restricting element, an orifice, a capillary tube, and a needle valve.

7. The two-stage pulse tube refrigerator of claim 1 also including four active valves disposed along the piping between the compressor and the hot ends of the first and second stage pulse tubes that cycle between on and off positions 180 degrees out of phase.

8. A two stage GM type pulse tube through flow compressor connected by gas lines to a valve mechanism that cycles flow to and from a pulse tube expander wherein;

each stage has a regenerator and a pulse tube;

each stage has a pair of valves that alternately admit high-pressure gas from the compressor and return gas to the compressor at low pressure;

the pressure cycle in each stage is 180° out of phase with the other; and a buffer tank is connected by a bypass channel to the hot end of the first stage pulse tube and to the hot end of the second stage pulse tube.

9. A two-stage pulse tube refrigerator in which the pressure cycling in each stage is 180° out of phase characterized by increased efficiencies and more compact designs, comprising two valves to limit the flow rates between the warm ends of the pulse tubes and a buffer volume that is connected between the two valves, such valves selected from the group consisting of passive and active valves, where second fixed valves connect the warm ends of the pulse tubes to the warm ends of their respective regenerators;

second active valves connect the warm ends of the pulse tubes to the warm ends of their respective regenerators; and two active valves connect the warm ends of each pulse tube to the high and low pressures of the compressor.

10. A two-stage pulse tube refrigerator in which the pressure cycling in each stage is 180° out of phase characterized by increased efficiencies and more compact designs, comprising one valve to limit the flow rate between the warm ends of the pulse tubes, such valve selected from the group consisting of passive and active valves, where second active valves connect the warm ends of the pulse tubes to the warm ends of their respective regenerators.

11. A two-stage pulse tube refrigerator in which the pressure cycling in each stage is 180° out of phase characterized by increased efficiencies and more compact designs, comprising one valve to limit the flow rate between the warm ends of the pulse tubes, such valve selected from the group consisting of passive and active valves, where two active valves connect the warm ends of each pulse tube to the high and low pressures of the compressor.

* * * * *